US006108514A

United States Patent [19]

Nakayama et al.

[11] Patent Number: 6,108,514

[45] Date of Patent: Aug. 22, 2000

[54] SHEET CONVEYING SYSTEM

[75] Inventors: Osamu Nakayama, Nara; Koichi Nakamura, Kyoto; Noritaka Okazaki, Nara; Masashi Hirai, Katano; Fumio Shimazu, Nara; Kiyoshi Toizumi, Yamatokoriyama, all of Japan

[73] Assignee: Sharp Kabushiki Kaisha, Osaka, Japan

[21] Appl. No.: 09/441,198

[22] Filed: Nov. 16, 1999

[30] Foreign Application Priority Data

Dec. 21, 1998 [JP] Japan ..... 10-362343
Dec. 21, 1998 [JP] Japan ..... 10-362344

[51] Int. Cl.[7] ..... G03G 15/00

[52] U.S. Cl. ..... 399/400

[58] Field of Search ..... 399/298, 121, 399/300, 302, 316, 317, 322, 323, 398, 399, 400; 198/469.1, 626.1, 626.3

[56] References Cited

U.S. PATENT DOCUMENTS 4,873,541 10/1989 Hirose et al. ..... 346/160.1
4,887,101 12/1989 Hirose et al. ..... 346/134
5,365,324 11/1994 Gu et al. ..... 399/400

FOREIGN PATENT DOCUMENTS 1078708 3/1998 Japan .

*Primary Examiner*—Arthur T. Grimley
*Assistant Examiner*—Hoang Ngo

[57] ABSTRACT

A sheet conveyance guide is configured of separation claws for separating the paper from a conveyer and transfer belt and a movable sheet guide for guiding the paper to a fixer entrance sheet guide. The separation claws are arranged on the upstream side of the movable sheet guide. The movable sheet guide is rotatable about a pivot shaft with its distal end abutted by gravity upon the upstream end part of the fixer entrance sheet guide.

The separation claws and movable sheet guide are axially supported so as to rotate on pivots.

The sheet conveyance guide moves together with the vertical movement of the conveyer and transfer belt while the abutment point of the separation claws upon the conveyer and transfer belt moves to the appropriate position.

10 Claims, 9 Drawing Sheets

SHEET CONVEYING SYSTEM

BACKGROUND OF THE INVENTION (1) Field of the Invention

The present invention relates to a sheet conveying system for use in image forming apparatus such as copiers, facsimile machines etc., in particular relating to a sheet conveying system for conveying a sheet from the image forming portion to the fixing portion as well as conveying a sheet from the paper feed portion to the image forming portion.

(2) Description of the Related Art

In a conventional digital color copier having image forming units of different colors, arranged in parallel to each other, a sheet conveyer belt is arranged opposing the image forming units of different colors and is used to convey the sheet along the image forming units of different colors, whereby the toner image of each color is transferred to the sheet superimposing one over another, and the thus transferred toner images of different colors are fixed to thereby form a full-color image.

In an image forming apparatus of this type, since image forming in the black mode is more frequently used than that in the full-color mode, if during image forming for only black images, image forming units of other colors (cyan, magenta and yellow) are kept in contact with the sheet conveyer belt, these image forming units degrade due to their friction with sheet conveyer belt. In order to prevent this degradation, the photosensitive members of the image forming units of these three colors need to be driven. This leads to lowering of the durability of the image forming units and the necessity of extra power consumption because the image forming units which are not required for the designated image forming are driven. In order to eliminate these problems, the image forming units for other than that for black imaging may be arranged so as to be able to move into and out of contact with the sheet conveyer belt, so that the image forming units other than that for black imaging are kept away from the sheet conveyer belt during image forming for only black images.

However, when the image forming units are configured to move into and output of contact with the sheet conveyer belt, toner images of the four colors are liable to be misregistered from one another when the toner images are superimposed one over another for full-color image formation. In order to prevent this, Japanese Patent Application Laid-Open Hei 10 No.78708 has been disclosed.

In the image forming apparatus disclosed in Japanese Patent Application Laid-Open Hei 10 No.78708, the image forming unit for black imaging is arranged on the most downstream side with respect to the sheet conveying direction, that is, in proximity to the fixing unit and the upstream part of the sheet conveyer belt is allowed to move into and out of contact with the image forming units on the upstream side.

However, in a configuration where the image forming unit for black imaging is arranged on the most downstream side and the upstream part of the sheet conveyer belt is allowed to move into and out of contact, the sheet entrance position moves greatly, that is, the relative positional relationship between to the paper feed portion and the sheet conveyer belt varies greatly, posing a problem in that the positional precision of sheet alignment lowers for sheet conveyance.

SUMMARY OF THE INVENTION

In order to solve the above problem, the present invention is configured as follows:

In accordance with the first aspect of the invention, a sheet conveying system includes:

a sheet conveying unit retaining and conveying a sheet;

a first switching unit for switching the state of the sheet conveying unit on the downstream side with respect to the sheet conveying direction, between a first conveyance position and a second conveyance position;

a separating member having an end part, on the upstream side with respect to the sheet conveying direction, abutted on the sheet conveying unit, for separating the sheet retained on the sheet conveying unit and guiding the sheet to the downstream side with respect to the sheet conveying direction;

a second switching unit for switching the separating member between a first separation/guidance position and a second separation/guidance position; and a sheet guide element located downstream of the separating member with respect to the sheet conveying direction, and is characterized in that when the state of the sheet conveying unit is switched by the first switching unit from the first conveyance position to the second conveyance position, the second switching unit switches the state of the separating member from the first separation/guidance position to the second separation/guidance position to change the abutment position of the end part, on the upstream side with respect to the sheet conveying direction, of the separating member upon the sheet conveying unit.

In accordance with the second aspect of the invention, the sheet conveying system having the above first aspect is characterized in that the sheet conveying unit rotates about a first pivot located on the upstream side with respect to the sheet conveying direction when the conveyance position is switched by the first switching unit; and the separating member rotates about a second pivot located on the side opposite to the direction of the movement of the sheet conveying unit from the first conveyance position to the second conveyance position, with respect to the horizontal line passing through the contact point between the sheet retaining surface of the sheet conveying unit and the sheet guide surface of the separating member.

In accordance with the third aspect of the invention, the sheet conveying system having the above second aspect is characterized in that the rotational arc locus of the sheet conveying unit about the first pivot differs from the rotational arc locus of the separating member about the second pivot.

In accordance with the fourth aspect of the invention, the sheet conveying system having the above first aspect is characterized in that the sheet guide element is axially supported on a rotary shaft so that its state is switched from the first guidance position to the second guidance position as the separating member is switched by the second switching unit from the first separation/guidance position to the second separation/guidance position.

In accordance with the fifth aspect of the invention, a sheet conveying system includes:

a first guide element for guiding a sheet conveyed by a sheet conveying unit;

a second guide element disposed downstream of the first guide element with respect to the sheet conveying direction;

a third guide element disposed between the first guide element and the second guide element for introducing the sheet guided by the first guide element to a second guide element; and a shifting unit for shifting the position of the first or second guide element in order to change the relative positional relationship between the first and second guide elements, and is characterized in that the third guide element is transformed and/or made to move its position in conformity with the position of the first or second guide element shifted by the shifting unit.

In accordance with the sixth aspect of the invention, the sheet conveying system having the above fifth aspect is characterized in that the first guide element is configured of the sheet conveying unit that conveys a sheet by attracting it thereto; and the third guide element is configured of an upstream side sheet guide having its upstream end part which is abutted against the first guide element and moves integrally therewith when the first guide element is moved by the shifting unit and a downstream side sheet guide which is transformed and/or made to move its position in conformity with the movement of the first guide element.

In accordance with the seventh aspect of the invention, the sheet conveying system having the above sixth aspect is characterized in that a projection is formed on the upstream end part of the second guide element or on the downstream end part of the third guide element in such a manner that the projection abuts the downstream side sheet guide of the third guide element or the sheet guide surface of the second guide element in order to create spacing between the downstream side sheet guide and the sheet guide surface of the second guide element, preventing the former from coming into contact with the latter.

In accordance with the eighth aspect of the invention, the sheet conveying system having the above fifth aspect is characterized in that the third guide element comprises a sheet detecting unit having a sheet detecting piece projected from the guide surface of the third guide element; and the sheet detecting unit is arranged so as to integrally move with the first or second guide element as they are moved by the shifting unit.

In accordance with the ninth aspect of the invention, the sheet conveying system having the above fifth aspect is characterized in that the third guide element is configured of an upstream side sheet guide having an upstream end part abutted on the first guide element and a downstream side sheet guide pivotally supported by a shaft on the upstream end side thereof; and a downstream end part of the downstream side sheet guide abuts the second guide element so that the abutment point serves as the point of action for rotating the downstream side sheet guide when the first or second guide element is moved by the shifting unit.

In accordance with the tenth aspect of the invention, the sheet conveying system having the above fifth aspect is characterized in that the third guide element is made to move its position and/or transformed in such a way that the deflection of the sheet guiding direction from the first guide element to the second guide element when the sheets are to be conveyed and guided is equal to or smaller than the deflection of the second guide element, and the third guide element is made to move its position and/or transformed in such a way that the deflection when no sheets are to be conveyed and guided is larger than the deflection of the second guide element.

Since the sheet conveying system defined as the first aspect is configured so that the conveyance position of the sheet conveying unit is switched on its downstream side, it is possible to improve the positional precision of paper alignment when a sheet is fed to the sheet conveying unit.

Further, when the state of the sheet conveying unit is switched by the first switching unit from the first conveyance position to the second conveyance position, the second switching unit switches the state of the separating member from the first separation/guidance position to the second separation/guidance position to change the abutment position of the end part, on the upstream side with respect to the sheet conveying direction, of the separating member upon the sheet conveying unit. Therefore, this configuration facilitates proper abutment of the separating member upon the sheet conveying unit, regardless of the conveyance position of the sheet conveying unit, thus making it possible to reliably separate and guide the sheet and hence prevent occurrence of sheet jamming.

The sheet conveying system defined as the second aspect is configured so that the sheet conveying unit rotates about the first pivot located on the upstream side with respect to the sheet conveying direction when the conveyance position is switched by the first switching unit; and the separating member rotates about the second pivot located on the side opposite to the direction of the movement of the sheet conveying unit from the first conveyance position to the second conveyance position, with respect to the horizontal line passing through the contact point between the sheet retaining surface of the sheet conveying unit and the sheet guide surface of the separating member. Therefore, when the sheet conveying unit moves, the separating member moves so as not to apply an excessive abutment force upon the abutment area on the sheet conveying unit. As a result, it is possible to reliably prevent damage to the sheet conveying unit due to abutment of the separating member.

In the sheet conveying system defined as the third aspect, it is possible to reliably prevent damage to sheet conveying unit due to abutment of the separating member, by simply differentiating the rotational arc of the sheet conveying unit about the first pivot from that of the separating member about the second pivot.

In the sheet conveying system defined as the fourth aspect, the sheet guide element is axially supported on a rotary shaft so that its state is switched from the first guidance position to the second guidance position as the separating member is switched by the second switching unit from the first separation/guidance position to the second separation/guidance position. Accordingly, this configuration facilitates proper abutment of the separating member upon the sheet conveying unit, regardless of the conveyance position of the sheet conveying unit, thus making it possible to reliably separate the sheet and stably convey the sheet after separation along the sheet guide element located downstream. Thus, it is possible to prevent occurrence of paper jamming.

In the sheet conveying system defined as the fifth aspect, when the first or second guide element is moved in order to change the relative positional relationship between the first and second guide elements, the third guide element is transformed and/or made to move its position in conformity with the position of the movement. Accordingly, it is possible to convey the sheet in a stable manner without degrading the conveyance state of the sheet from the first guide element to the second guide element.

In the sheet conveying system defined as the sixth aspect, since the upstream side sheet guide of the third guide element integrally moves while abutting the first guide element even when the first guide element, i.e., the sheet conveying unit for conveying the sheet as attracting it thereto is moved, it is possible to reliably receive the sheet from the first guiding element and hence stably convey it to the second guide element.

Further, in the case where, for example, the sheet conveying unit as the first guide element is applied to convey a sheet to the image forming portion of the image forming apparatus and convey the sheet formed with a toner image by the image forming portion, the third guide element moves integrally with the first guide element so that the third guide element will not damage the first guide element surface, and hence it is possible to prevent degradation of the image quality due to damage when a halftone image is formed by the image forming portion.

In the sheet conveying system defined as the seventh aspect, the projection creates spacing between the downstream side sheet guide and the sheet guide surface of the second guide element so that the two elements will not come into contact with each other. Therefore, it is possible to prevent damage to the sheet guide surface of the second guide element due to the abutment of the downstream side sheet guide portion.

Further, in a case where the sheet guide surface of the second guide element is coated with a fluororesin such as Teflon etc. in order to improve its sheet conveyance, it is possible to reliably prevent the membrane of the fluororesin from being damaged.

In the sheet conveying system defined as the eighth aspect, since the sheet detecting is provided so as to move integrally with the first or second guide element which is moved by the shifting unit, the projected amount of the sheet detecting piece of the sheet detecting unit will not vary very much if the third guide element moves. Thus, this configuration can realize correct detection of the paper conveyance.

Further, since the sheet detecting unit moves together with the first or second guide element, the tilt of the sheet detecting unit can be minimized. For example, in a case where conveyance of a sheet is detected by the switching of the position of the sheet detecting piece between the vertical position due to gravity and the horizontal position due to abutment during sheet conveyance, it is possible to suppress changes in the vertical position of the sheet detecting piece by gravity, and hence prevent mal-detection due to the swaying of the sheet detecting unit.

In the sheet conveying system defined as the ninth aspect, the third guide element is configured of the upstream side sheet guide having the upstream end part abutted on the first guide element and the downstream side sheet guide pivotally supported by the shaft on the upstream end side thereof; and the downstream end part of the downstream side sheet guide abuts the second guide element so that the abutment point serves as the point of action for rotating the downstream side sheet guide when the first or second guide element is moved by the shifting unit. Accordingly, the abutment position between the downstream side sheet guide and the second guide element moves from one to the next as the third guide element moves. In this way, the downstream side sheet guide will not move abruptly when the third guide element moves and hence it is possible to prevent damage to the downstream side sheet guide due to its collision with other elements.

In the sheet conveying system defined as the tenth aspect, when sheet conveyance and guidance is prohibited, for example, during paper jam handling, the third guide element is made to move its position and/or transformed in such a way that the inclination of the third guide element is larger then the inclination of the second guide element. Therefore, a large margin of movement of the first guide element can be taken during the paper jam handling, thus enabling the user to easily perform paper jam cancellation.

DESCRIPTION OF THE PREFERRED EMBODIMENTS

The embodiment of a digital color copier as an image forming apparatus of the present invention will be described with reference to the accompanying drawings.

Figure 1:
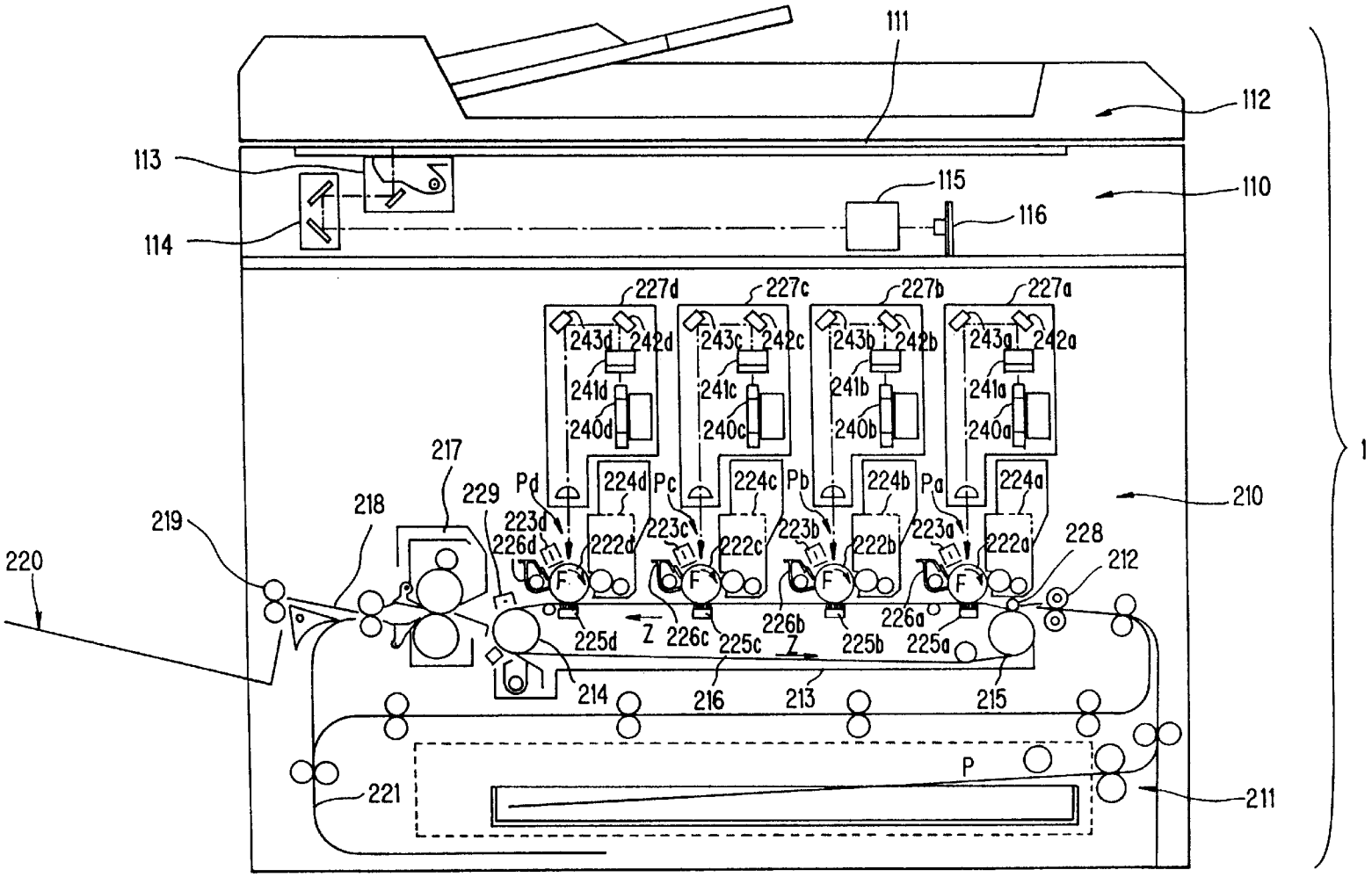
FIG. 1 is an overall sectional view showing the embodiment of a digital color copier of the present invention.

FIG. 1 is an overall sectional view showing a configuration of a digital color copier.

A copier body 1 of this digital color copier has an original table 111 and an unillustrated control panel on the top thereof and has an image reading portion 110 and an image forming unit 210 within.

A recirculating automatic document feeder (RADF) 112 is arranged on the top surface of original table 111 in the predetermined position with resect to the original table 111 surface, whilst being supported so as to be opened and closed relative to original table 111.

RADF 112, first, conveys an original so that the one side of the original opposes image reading portion 110 at the predetermined position on original table 111. After the image scanning of this side is completed, the original is inverted and conveyed to original table 111 so that the other side opposes image reading portion 110 at the predetermined position on original table 111.

Then, when RADF 112 completes image scanning of both sides of one original, the original is discharged and the duplex copy conveying operation for a next document is effected.

The operation of the conveyance and face inversion of the original is controlled in association with the whole copier operation.

Image reading portion 110 is disposed below original table 111 in order to read the image of the original conveyed onto original table 111 by means of RADF112. Image reading portion 110 includes original scanning portion 113 and 114 which reciprocates along, and in parallel to, the undersurface of original table 111, an optical lens 115 and a CCD line sensor 116 as a photoelectric converting device.

This original scanning portion 113 and 114 is composed of first and second scanner units 113 and 114. First scanner unit 113 has an exposure lamp for illuminating the original image surface and a first mirror for deflecting the reflection image of light from the original toward the predetermined direction moves in a reciprocating manner in parallel with, while being kept a certain distance away from, the undersurface of original table 111 at the predetermined speed. Second scanner unit 114 has second and third mirrors which deflect the reflected light image from the original, deflected by first mirror of first scanner unit 113 toward the predetermined direction and moves in a reciprocating manner at a speed related to that of first scanner unit 113 and in parallel thereto.

Optical lens 115 reduces the reflected light image from the original, thus deflected by third mirror of second scanner unit 114, so that the reduced light image will be focused on the predetermined position on CCD line sensor 116.

CCD line sensor 116 photoelectrically converts the focused light image into an electric signal and outputs it. CCD line sensor 116 is a three-line color CCD which can read monochrome and color images and output line data as to color separation components R(red), G(green) and B(blue). The original image information thus obtained as the electric signal from this CCD line sensor 116 is further transferred to an unillustrated image processor where the predetermined image data processes are performed.

Next, the configuration of image forming unit 210 and the configuration of the components related to image forming portion 210 will be described.

Provided below image forming portion 210 is a paper feeding mechanism 211 which separates a sheet of paper (sheet) P, one by one, from a stack of paper held in a paper feed cassette and feeds it toward image forming portion 210. The paper P thus separated and fed sheet by sheet is delivered into image forming portion 210 with its timing controlled by a pair of registration rollers 212 located before image forming portion 210. The paper P with an image formed on its one side is conveyed and re-fed to image forming portion 210 in time with image forming of image forming portion 210.

Arranged under image forming portion 210 is a conveyer and transfer belt mechanism 213. Conveyer and transfer belt mechanism 213 is composed of a driving roller 214, an idle roller 215 and a conveyer and transfer belt 216 wound and tensioned between the two rollers so as to convey paper P being attracted to the belt by electrostatic force.

Further, a pattern image detecting unit is provided under and in proximity to conveyer and transfer belt 216.

Arranged in the paper conveyance path, downstream of conveyer and transfer belt mechanism 213 is a fixing unit 217 for fixing the toner image transferred on paper P onto paper P. Paper P having passed through the nip between a pair of fixing rollers of fixing unit 217 passes through a conveyance direction switching gate 218 and is discharged by discharge rollers 219 to a paper output tray 220 attached to the outer wall of copier body 1.

This switching gate 218 selectively connects the conveyance path of paper P after fixing with either the path to discharge paper P to the outside of copier body 1 or the path to recirculate paper P toward image forming portion 210.

The paper P which is designated to be conveyed again to image forming portion 210 by means of switching gate 218 is inverted by means of a switch-back conveyance path 221 and then re-fed to image forming portion 210.

Arranged above, and in proximity to, conveyer and transfer belt 216 in image forming portion 210 are the first image forming station Pa, the second image forming station Pb, the third image forming station Pc and the fourth image forming station Pd, in the above mentioned order from the upstream side of the paper conveyance path.

Transfer conveyance roller 216 is frictionally driven by driving roller 214 in the direction indicated by arrow Z in FIG. 1, and carries paper P which is fed by paper feeding mechanism 211 as stated above and sequentially conveys it to image forming stations Pa to Pd.

All the image forming stations Pa to Pd are of a substantially identical configuration. Each image forming station Pa, Pb, Pc and Pd has a photosensitive drum 222*a*, 222*b*, 222*c* and 222*d*, which is driven in the rotational direction indicated by arrow F in FIG. 1.

Provided around each photosensitive drum 222*a* to 222*d*, are a primary charger 223*a*, 223*b*, 223*c* and 223*d* for uniformly charging photosensitive drum 222*a*, 222*b*, 222*c* and 222*d*, a developing unit 224*a*, 224*b*, 224*c* and 224*d* for developing the static latent image formed on photosensitive drum 222*a*, 222*b*, 222*c* and 222*d*, a transfer charger 225*a*, 225*b*, 225*c* and 225*d* for transferring the developed toner image on photosensitive drum 222*a*, 222*b*, 222*c* and 222*d* to paper P, cleaning unit 226*a*, 226*b*, 226*c* and 226*d* for removing the leftover toner from photosensitive drum 222*a* to 222*d*, in this order with respect to the rotational direction of each photosensitive drum 222*a*, 222*b*, 222*c* and 222*d*.

Arranged above photosensitive drums 222*a* to 222*d* are laser beam scanner units 227*a*, 227*b*, 227*c* and 227*d*, respectively. Each laser beam scanner unit 227*a* to 227*d* includes: a semiconductor laser element (not shown) for emitting a spot beam modulated in accordance with the image data; a polygon mirror (deflecting device) 240 for deflecting the laser beam from the semiconductor laser element, in the main scan direction; an f-theta lens 241 for focusing the laser beam deflected by polygon mirror 240 on the surface of photosensitive drum 222*a* to 222*d*; and mirrors 242 and 243.

The pixel signal corresponding to the black component image of a color original image is supplied to laser beam scanner unit 227*a*; the pixel signal corresponding to the cyan color component image of a color original image is supplied to laser beam scanner unit 227*b*; the pixel signal corresponding to the magenta color component image of a color original image is supplied to laser beam scanner unit 227*c*; and the pixel signal corresponding to the yellow color component image of a color original image is supplied to laser beam scanner unit 227*d*.

In this arrangement, the static latent images corresponding to the color separations of the original image information are formed on photosensitive drums 222*a* to 222*d*. Developing units 224*a*, 224*b*, 224*c* and 224*d* hold black toner, cyan color toner, magenta color toner, yellow color toner, respectively. The static latent image on photosensitive drum 222*a* to 222*d* is developed by the toner of a corresponding color. Thus, the color separations of the original image information are reproduced as toner images of different colors.

Provided between the first image forming station Pa and paper feeding mechanism 211 is a paper-attraction charger (brush) 228, which electrifies the conveyer and transfer belt 216 surface so that paper P fed from paper feeding mechanism 211 can be conveyed without any slip or slide, whilst being reliably attracted to conveyer and transfer belt 216, from the first image forming station Pa to the fourth image forming station Pd.

An erasing device 229 is arranged approximately right above driving roller 214 located between the fourth image forming station Pd and fixing roller 217. Applied to this erasing device 229 is an alternating current for separating paper P electrostatically attracted to conveyer and transfer belt 216, from the belt.

In the thus configured digital color copier, cut-sheet type paper is used as paper P. When paper P is delivered from the paper feed cassette to the guide of the paper conveyance path of paper feeding mechanism 211, the leading edge of paper P is detected by a sensor (not shown), which outputs a detection signal, based on which a pair of registration rollers 212 briefly stops the paper.

Then, paper P is delivered in synchronization with image forming stations Pa to Pd, onto conveyer and transfer belt 216 rotating in the direction of arrow Z in FIG. 1. Meanwhile, conveyer and transfer belt 216 has been charged in a predetermined manner by paper attraction charger 228 as stated above, so that paper P is stably fed and conveyed throughout the passage of all the image forming stations Pa to Pd.

In each image forming station Pa to Pd, the toner image of each color is formed so that the different color images are superimposed on the support surface of paper P which is conveyed while being electrostatically attracted by conveyer and transfer belt 216. When transfer of the image formed by the fourth image forming station Pd is completed, paper P is separated by virtue of erasing device 229, continuously starting at its leading edge, from conveyer and transfer belt 216 and introduced into fixing unit 217.

Finally, paper P having the toner image fixed thereon is discharged through the paper discharge port (not shown) onto paper output tray 220.

In the above description, writing to the photosensitive drums 222*a* to 222*d* is performed by laser beam scanning exposure using laser beam scanner units 227*a* to 227*d*. However, instead of the laser beam scanner units, another type of an optical writing system made up of a light emitting diode array with a focusing lens array (LED head) may be used. An LED head is smaller in size compared to a laser beam scanner unit and has no moving parts hence is silent. Therefore, this LED head can be preferably used for image forming apparatuses such as digital color copiers of a tandem arrangement type needing a plurality of optical writing units.

The above conveyer and transfer belt 216 is configured so as to be in contact with photosensitive drums 222*a* to 222*d* of image forming stations Pa to Pd of different colors in the full-color mode, whereby the toner images developed via image forming stations Pa to Pd are transferred to the sheet of paper to produce a full-color image. Conveyer and transfer belt 216 is configured so as to be put in contact with only photosensitive drum 222*a* of image forming station Pa for black imaging in the monochrome mode (black imaging mode) so as to form black images only while photosensitive drums 222*b* to 222*d* of image forming stations Pb to Pd of other colors are never in contact. Further, conveyer and transfer conveyer belt 216 is configured so as to be moved down keeping its configuration as either in the full-color mode or in the monochrome mode when jamming occurs, to thereby separate itself away from photosensitive drums 222*a* to 222*d* of image forming stations Pa to Pd and create a space for allowing for removal of jammed paper.

Further, a sheet conveyance guide 31, as the third guide element, provided downstream of conveyer and transfer belt 216 and upstream of fixing unit 217, is configured so as to change its position or transform in accordance with the spacing when conveyer and transfer belt 216 is set away from image forming stations Pa to Pd as stated above, to thereby stabilize sheet conveyance.

First, the separating mechanism of conveyer and transfer belt 216 will be described and then sheet conveyance guide 31 located on the downstream side of conveyer and transfer belt 216 will be explained.

Figure 2:
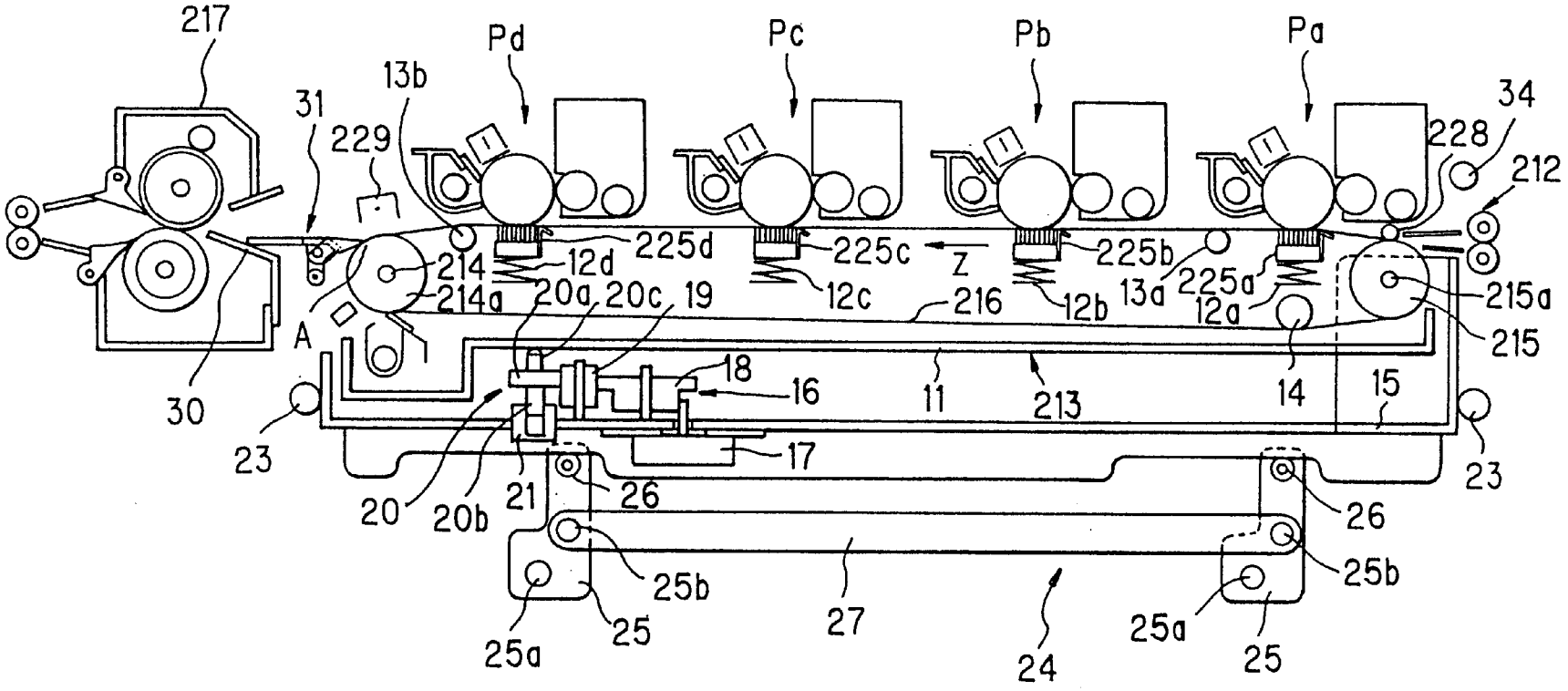
FIG. 2 is a sectional view showing a sheet conveying system in the full-color mode in the first embodiment of a full-color copier of the invention.
Figure 3:
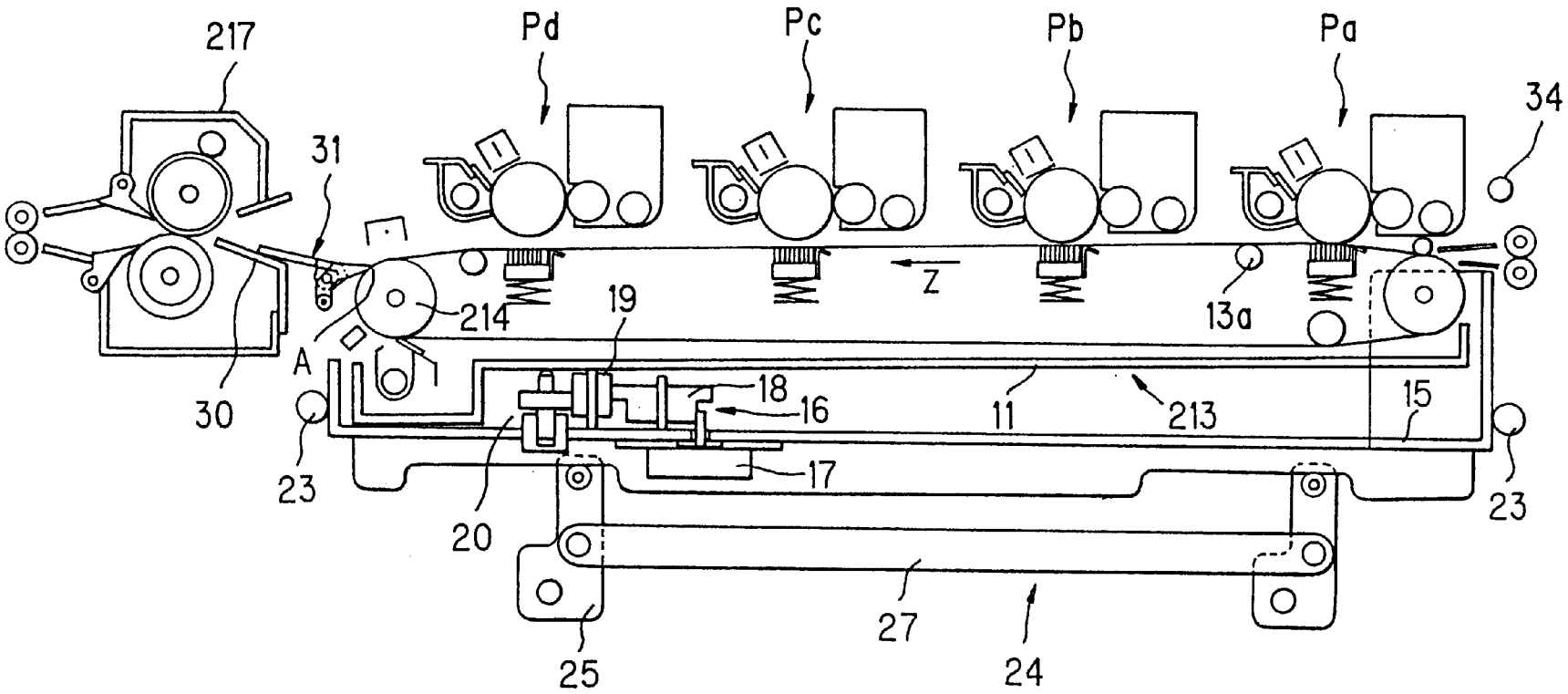
FIG. 3 is a sectional view showing a sheet conveying system in the monochrome mode in the first embodiment of a full-color copier of the invention.
Figure 4:
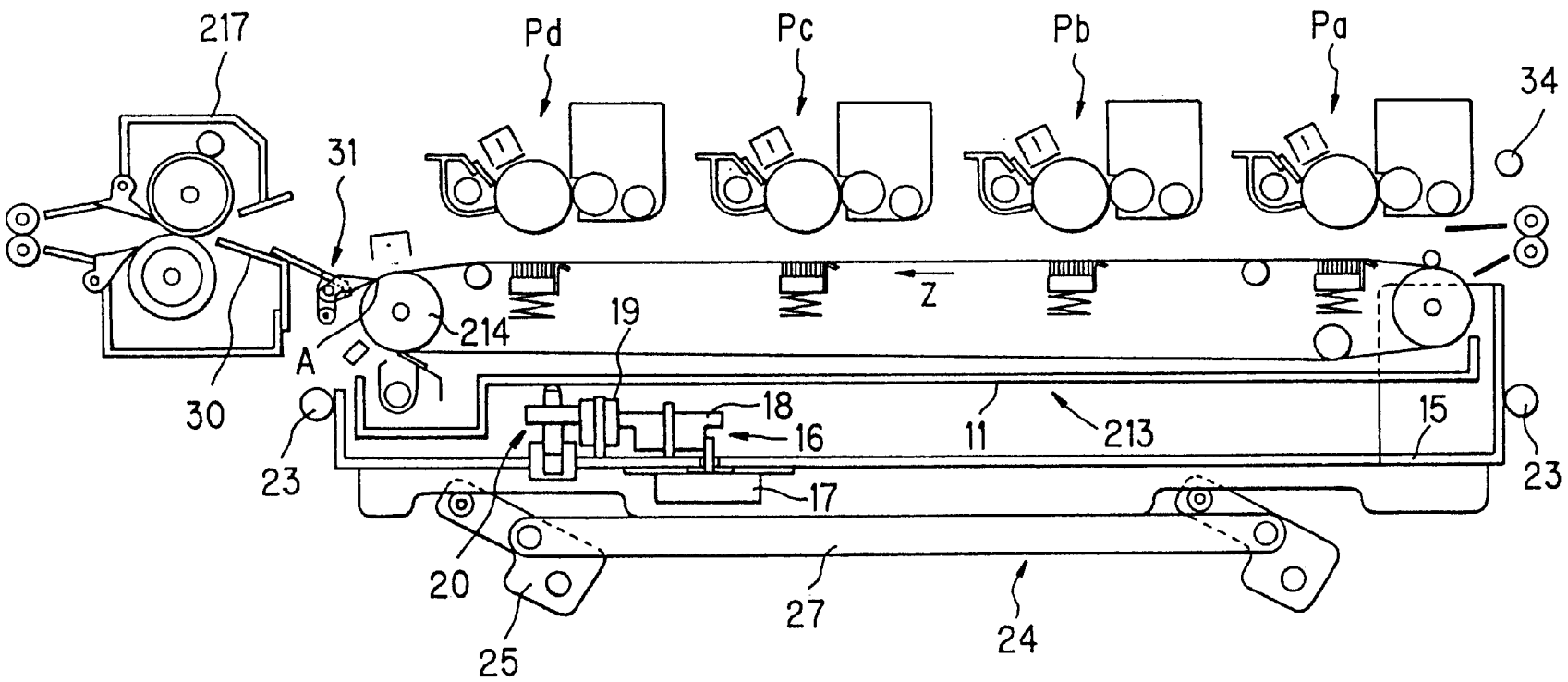
FIG. 4 is a sectional view showing the state during paper jam handling of a sheet conveying system in the first embodiment of a full-color copier of the invention.

The separating mechanism of conveyer and transfer belt 216 will be described with reference to FIGS. 2 to 4. FIG. 2 is a sectional view showing the state in the full-color mode; FIG. 3 is a sectional view showing the state in the monochrome mode; and FIG. 4 is a sectional view showing the state during paper jam handling.

As shown in FIG. 2, the first guide element, i.e., conveyer and transfer belt 216 is tensioned between driving roller 214 and driven roller 215 with assist rollers 13 and a tension roller 14, and moves in the Z-direction in the drawing, by rotation of these rollers.

Driving roller 214 and driven roller 215 are attached to driving roller shaft 214*a* and driven roller shaft 215*a*, respectively. Assist rollers 13*a* and 13*b* and tension roller 14 are attached to unillustrated rotary shafts.

Driving roller shaft 214*a*, the rotary shafts of the tension roller and assist rollers 13*b* are axially supported by a first transfer frame 11 so as to be rotatable. Driven roller shaft 215*a* is axially supported by a second transfer frame 15 so as to be rotatable.

First transfer frame 11 is rotatably supported by driven roller shaft 215*a* by means of a bearing.

The rotary shaft of assist roller 13*a* is axially supported by second transfer frame 15 so as to be rotatable.

First transfer frame 11 retains transfer chargers 225*a* to 225*d* which are resiliently urged by springs 12*a* to 12*d* toward photosensitive drums 222*a* to 222*d*, respectively, with conveyer and transfer belt 216 in between. In this case, transfer chargers 225*a* to 225*d* are limited so that their strokes of movement with respect to first transfer frame 11 are constant.

Provided in second transfer frame 15 below first transfer frame 11 is a drive mechanism 16 for producing the separation movement of conveyer and transfer belt 216. This drive mechanism 16 is configured of a drive motor 17, transmission gears 18 and 19, a conveyer belt positioning shaft 20 and a female thread portion 21. An output shaft 17*a* of drive motor 17 is formed with gear teeth meshing transmission gear 18. Conveyer belt positioning shaft 20 is configured of a gear portion 20*a*, a male thread portion 20*b* and an abutment portion 20*c*. Gear portion 20*a* meshes transmission gear 19 while male thread portion 20*b* meshes female thread portion 21.

With this configuration, if drive motor 17 rotates in the normal direction, conveyer belt positioning shaft 20 moves up whereas if drive motor 17 rotates in the reverse direction, conveyer belt positioning shaft 20 moves down. Abutment portion 20*c* of conveyer belt positioning shaft 20 abuts the undersurface of first transfer frame 11 so as to support first transfer frame 11 having conveyer and transfer belt 216, driving roller 214, transfer chargers 225*a* to 225*d* etc., to thereby position the first transfer frame 11, that is, control its contact or separation with respect to photosensitive drums 222*a* to 222*d*.

By the above drive mechanism 16, in the full-color mode, conveyer belt positioning shaft 20*c* moves to the highest position to raise first transfer frame 11 to its highest position so that conveyer and transfer belt 216 comes into contact with all image forming stations Pa to Pd, as shown in FIG. 2. In this position, the toner images of different colors formed on photosensitive drums 222*a* to 222*d* of image forming stations Pa to Pd are successively transferred to paper P as it is conveyed by conveyer and transfer belt 216.

In the monochrome mode, conveyer and transfer belt 216, which has been in contact with photosensitive drums 222*a* to 222*d* of all image forming stations Pa to Pd in the fullcolor mode is moved as drive motor 17 turns so as to move down first transfer frame 11. Resultantly, first transfer frame 11 moves downwards and hence conveyer and transfer belt 216 on the driving roller 214 side moves away from image forming station Pd so that only photosensitive drum 222*a* of image forming station Pa for black imaging is kept in contact with the belt while image forming stations Pb to Pd of other colors separate from the belt, as shown in FIG. 3.

During the above operation, assist roller 13*a* will not move together with the rotational movement (separating movement) of first transfer frame 11 since assist roller 13*a* is axially supported by second transfer frame 15. Therefore, the contact state of conveyer and transfer belt 216 with photosensitive drum 222*a* in the transfer area between photosensitive drum 222*a* and transfer charger 225*a* is stably maintained.

This configuration eliminates the necessity of driving image forming stations Pb to Pd in the monochrome mode in order only to convey the paper P with a black toner image transferred thereon, to fixing unit 217, thus improving the durability of image forming stations Pb to Pd. And yet, the position of conveyer and transfer belt 216 does not move on the entrance side of paper P, which means that the relative positional relationship between registration rollers 212 and conveyer and transfer belt 216 is unvaried resulting in no positional misalignment of paper P when it is conveyed and allowing paper P to be conveyed stably.

Next, the separating mechanism of conveyer and transfer belt 216 upon paper jam handling will be described.

A lift mechanism 24 is arranged in the underside of second transfer frame 15 in FIG. 2. This lift mechanism 24 is configured of a pair of rotary plates 25 rotatably supported at support shafts 25*a* on both the upstream (driven roller 215) side and the downstream (drive roller 214) side with respect to conveyer and transfer belt 216, a linkage plate 27 linking rotary plates 25, and a control handle (not shown) integrally provided with the upstream side support shaft 25*a*.

Rotary plates 25 and linkage plate 27 are connected at linkage supports 25*b*. Each rotary plate 25 has a lift roller 26. These lift rollers 26 abut cutout portions 15*a* formed in second transfer frame 15 so as to support second transfer frame 15.

In the event of paper jamming, when the user operates the control handle, the upstream side support shaft 25*a* rotates together with the upstream side rotary plate 25. The rotation of upstream side rotary plate 25 causes the downstream side rotary plate 25 to rotate in the same direction as upstream side rotary plate 25 by virtue of linkage plate 27. Thereby, second transfer frame 15 moves up and down so as to allow conveyer and transfer belt 216 to move up and down.

Guide rollers 23 are arranged to limit second transfer frame 15 so as not to move horizontally when second transfer frame 15 moves up and down. In this state, all the image forming stations Pa to Pd are not located in proximity to conveyer and transfer belt 216, so that the user can take the appropriate action for paper jamming etc., over conveyer and transfer belt 216. By these mechanical arrangements, it is possible to create a space between conveyer and transfer belt 216 and photosensitive drums 222*a* to 222*d* during paper jam handling occurs, as shown in FIG. 4.

Next, description will be made of a sheet conveyance guide 31 which moves in linkage with the contact and separation movement of conveyer and transfer belt 216 with respect to image forming stations Pa to Pd.

As stated above, conveyer and transfer belt 216 is configured to move up or down in accordance with the selected mode while the position of fixing unit 217 is fixed. For this reason, the paper conveyed to fixing unit 217 by conveyer and transfer belt 216 must be separated properly from conveyer and transfer belt 216 in the monochrome mode where conveyer and transfer belt 216 is set at the lower position, in the same manner as in the full-color mode. Improper separation may cause jamming of paper P or may disturb the proper conveyance of paper P into the fixing nip between fixing rollers 217*a* and 217*b* in fixing unit 217, possibly causing the paper to be wrinkled when it is fixed. For these reasons, proper separation of paper P from conveyer and transfer belt 216 is a must.

Arranged immediately before fixing unit 217 is a fixer entrance sheet guide 30 as the second guide element. This fixer entrance sheet guide 30 guides paper P to the nip between fixing rollers 217*a* and 217*b* in order to prevent paper P from being wrinkled when paper P is fixed by being nipped and conveyed by the fixing nip between fixing rollers 217*a* and 217*b* of fixing unit 217.

If paper P is curved so as to form a small crest or a shallow trough in the center of paper P with respect to the direction perpendicular to the paper's direction of conveyance when the leading edge of paper P enters the nip between fixing rollers 271*a* and 217*b*, the risk of paper P being wrinkled can be markedly reduced. However, when, for example, paper P has a crest or trough off-center, when paper P has a large curvature, or when paper P has a multiple number of crests and troughs even though they are small, the probability of wrinkles becomes markedly greater.

When the position of conveyer and transfer belt 216 is shifted from the full-color mode to the monochrome mode, if the mid portion between fixer entrance sheet guide 30 and conveyer and transfer belt 216 remains high, the leading edge of paper P once moves up and then moves down. So paper P enters the nip between fixing rollers 217*a* and 217*b* with its leading edge swaying largely, resulting in a high risk of wrinkles being formed.

Figure 5A:
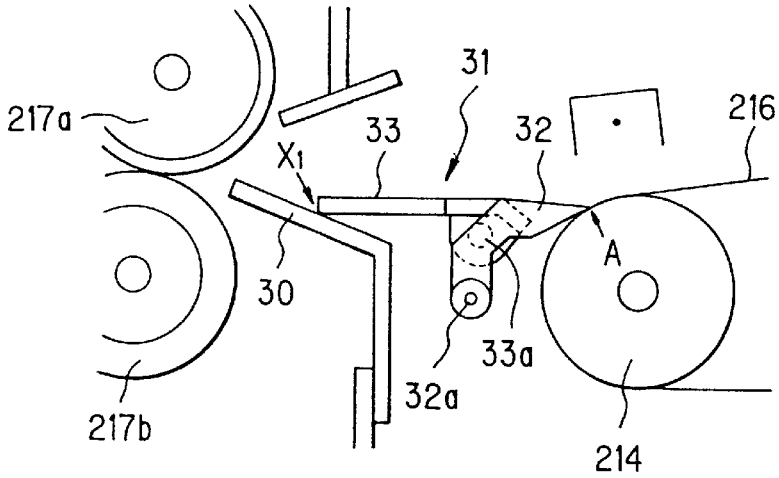
FIGS. 5A to 5C are partially enlarged views of a sheet conveying system in accordance with the first embodiment of a digital color copier of the invention, FIG. 5A showing the state in the full-color mode, FIG. 5B showing the state in the monochrome mode and FIG. 5C showing the state during paper jam handling.
Figure 5B:
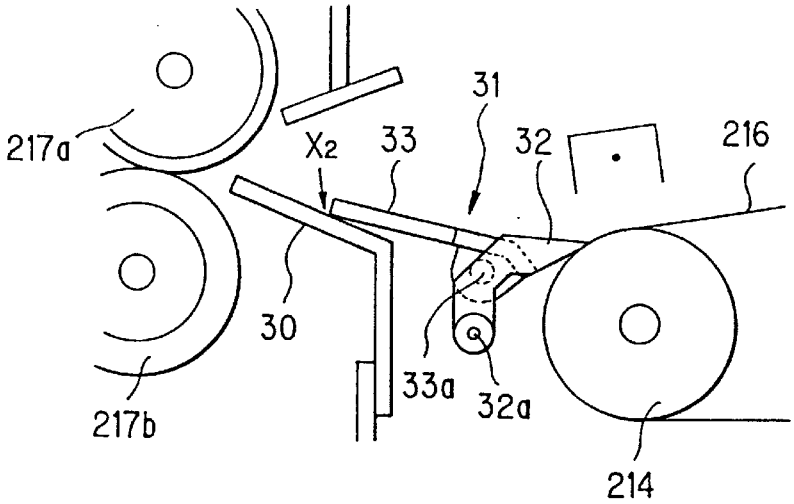
Figure 5C:
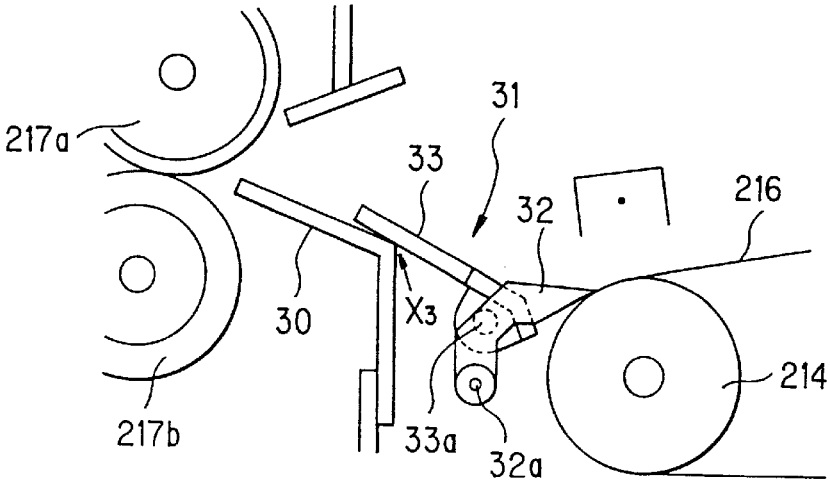
Figure 6:
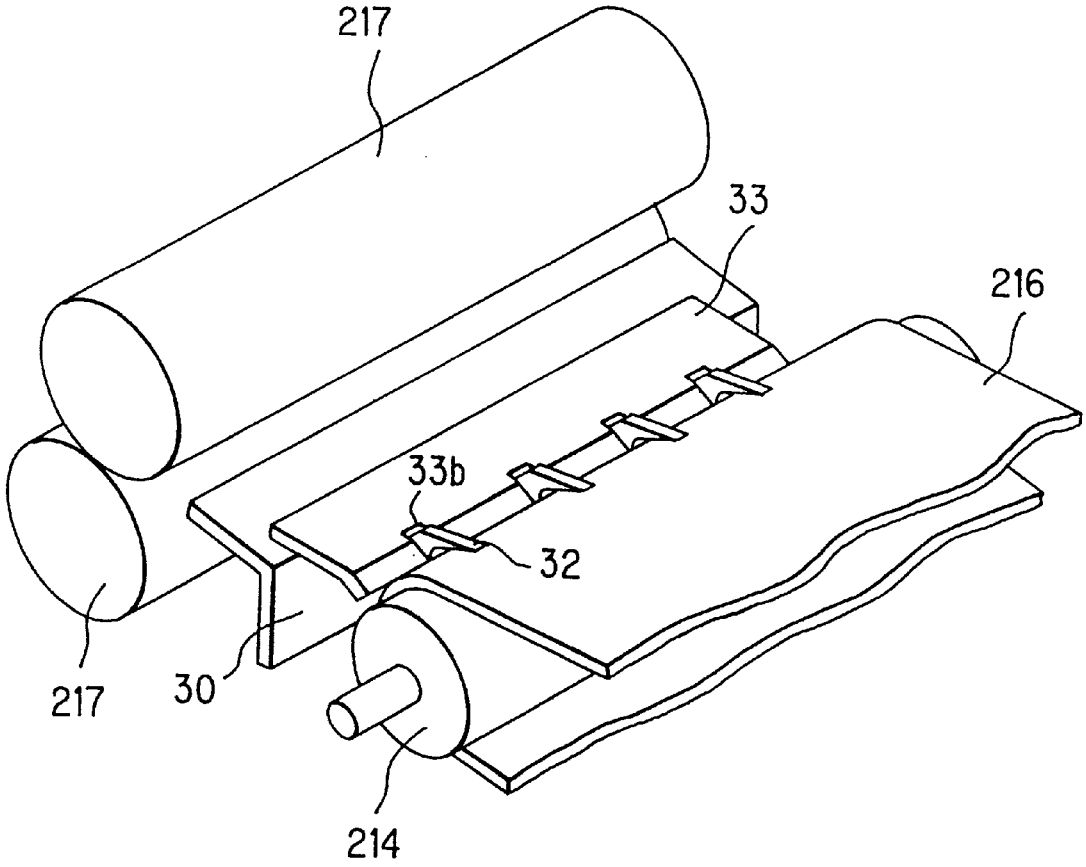
FIG. 6 is a perspective view showing the essential components of a sheet conveying system in the first embodiment of a digital color copier of the invention.

Now, description will be made of the first embodiment of sheet conveyance guide 31 which is configured so as to make proper separation of paper P from conveyer and transfer belt 216 by conveying paper P to the nip between fixing rollers 217*a* and 217*b* while not causing the leading end of paper P to sway greatly and cause any curvature that generates wrinkles at the front end of paper P. FIG. 5A is a sectional view showing the state of sheet conveyance guide 31 in the full-color mode, FIG. 5B is a sectional view showing the state of sheet conveyance guide 31 in the monochrome mode and FIG. 5C is a sectional view showing the state of sheet conveyance guide 31 during paper jam handling. FIG. 6 is a perspective view of sheet conveyance guide 31.

As shown in FIG. 5A and FIG. 6, sheet conveyance guide 31 is composed of separation claws 32 as the upstream side sheet guide for separating paper P from conveyer and transfer belt 216 and a movable sheet guide 33 as the downstream side sheet guide for guiding paper P to fixer entrance sheet guide 30, with separation claws 32 being arranged in cutout portions 33*b* (FIG. 6) formed on the upstream side of movable sheet guide 33.

Each separation claw 32 can rotate on its separation claw shaft 32*a* as the center axle and its front part is urged against conveyer and transfer belt 216 by a spring with an urging force low enough so as not to damage conveyer and transfer belt 216.

Movable sheet guide 33 is rotatable on pivot shaft 33*a* and the front part of movable sheet guide 33 abuts on the upstream end of fixer entrance sheet guide 30 by gravity.

The sheet conveyance guide 31 comprised of separation claws 32 and movable sheet guide 33 is provided rotatably on pivot 34 as the center axle, located on the upstream side of conveyer and transfer belt 216 as shown in FIGS. 2 through 4.

This pivot 34 is located above the horizontal line passing through the contact point A between separation claw 32 and conveyer and transfer belt 216 on its downstream side (is located on the opposite side with respect to the descending direction of conveyer and transfer belt 216 on its downstream side).

Accordingly, in the full-color mode, separation claws 32 abut conveyer and transfer belt 216 as shown in FIG. 5A so as to separate and guide the paper P being conveyed by conveyer and transfer belt 216 and then movable sheet guide 33 guides it correctly into the fixing nip between fixing rollers 217*a* and 217*b* of fixing unit 217.

Separation claw shaft 32*a* and pivot shaft 33*a* of movable sheet guide 33 are both supported rotatably by first transfer frame 11, hence these move up and down together with first transfer frame 11 by the action of drive mechanism 16 or by the operation of lift mechanism 24.

Because of the above arrangement, movable sheet guide 33 changes its position as shown in FIG. 5B with the mode change from the full-color mode to the monochrome mode.

More specifically, when the operational mode changes from the full-color mode to the monochrome mode, first transfer frame 11 is moved from the state shown in FIG. 2 to the state shown in FIG. 3 (where the driving roller 214 side is moved down) by the action of drive mechanism 16, while sheet conveyance guide 31 rotates about pivot 34 so that separation claws 32 and movable sheet guide 33 which are axially supported by first transfer frame 11 move down together.

At this moment the rotational arc locus of the conveyer and transfer belt 216 differs from the rotational arc locus of the sheet conveyance guide 31. To be more specific, since sheet conveyance guide 31 moves toward the conveyer and transfer belt 216 side, the abutment point of separation claws 32 of sheet conveyance guide 31 upon conveyer and transfer belt 216 moves rightward, from the state shown in FIG. 5A to the state shown in FIG. 5B.

Therefore, the separation claws move following conveyer and transfer belt 216, so that they can be set at suitable positions to correctly perform separation of paper P while sheet conveyance guide 31 can be moved without damaging conveyer and transfer belt 216.

In this case, since fixing unit 217 is fixed, fixer entrance sheet guide 30 does not move. Therefore, the pivot shaft 33*a* side moves down with the downstream end of movable sheet guide 33 kept in abutment with fixer entrance sheet guide 30, and the downstream end of movable sheet guide 33 rotates upwards about pivot shaft 33*a*. Paper P which has been separated and guided from conveyer and transfer belt 216 by separation claws 32, is guided along movable sheet guide 33 to reach fixer entrance sheet guide 30.

The upper surface of each separation claw 32 serves as a sheet guide surface and its downstream side is positioned above the upper surface of movable sheet guide 33 as a sheet guide surface. Thus, the leading edge of paper P is prevented from being caught on the sheet guide 33 by causing the step therebetween.

The inclination of the sheet guide surface of separation claw 32, the inclination of the sheet guide surface of movable sheet guide 33 and the inclination of the sheet guide surface, i.e., the upper surface of fixer entrance sheet guide 30 with respect to the horizontal become equal to each other or greater in this sequential order.

In this way, in the monochrome mode, movable sheet guide 33 is set in such a position that the sheet guide surface of movable sheet guide 33 has an inclination between the inclination of the sheet guide surface of separation claw 32 and the inclination of the sheet guide surface of fixer entrance sheet guide 30. Therefore, the leading end of paper P separated from conveyer and transfer belt 216 is guided by these continuously upwardly inclined surfaces, so that the leading end of paper P will not sway largely and can be stably guided into the nip between fixing rollers 217*a* and 217*b* of fixing unit 217, thus suppressing paper P from being wrinkled.

When lift mechanism 24 is operated for paper jam handling, sheet conveyance guide 31 is further moved down as shown in FIG. 5C, compared to the monochrome mode position shown in FIG. 5B.

At this moment, movable sheet guide 33 of sheet conveyance guide 31 is inclined greatly compared to the state shown in FIG. 5B. However, since no paper P is conveyed during paper jam handling, no problem occurs if the inclination of movable sheet guide 33 is too large.

Movable sheet guide 33 rotates about pivot shaft 33*a* as conveyer and transfer belt 216 moves up and down as stated above, while the downstream end of movable sheet guide 33 is always located above the upstream end of fixer entrance sheet guide 30 so as to cover the upstream end of fixer entrance sheet guide 30. Therefore, if the relative positional relationship between conveyer and transfer belt 216 and fixer entrance sheet guide 30 varies as conveyer and transfer belt 216 moves up or down, the junctions between the individual sheet guide surfaces of separation claws 32 of sheet conveyance guide 31, movable sheet guide 33 and fixer entrance sheet guide 30 will not form a step that disturbs paper conveyance, so that no jamming, flexure, etc., will occur.

Further, since separation claws 32 move following conveyer and transfer belt 216, in a similar manner as the movement from the state of FIG. 5A to that of FIG. 5B, sheet conveyance guide 31 can be moved without damaging conveyer and transfer belt 216.

On the other hand, when the apparatus state is changed from that of FIG. 5C to that of FIG. 5B, and from that of FIG. 5B to that of FIG. 5A, separation claws 32 move so as to run away from conveyer and transfer belt 216. Therefore, sheet conveyance guide 31 can be moved without damaging conveyer and transfer belt 216.

Concerning the abutment point of movable sheet guide 33 on fixer entrance sheet guide 30, abutment point $X_1$ in the full-color mode shown in FIG. 5A, abutment point $X_2$ in the monochrome mode shown in FIG. 5B and abutment point $X_3$ in the paper jam handling state shown in FIG. 5C are located on the sheet guide surface of fixer entrance sheet guide 30, in this sequential order from the downstream side to the upstream.

Therefore, when the operation state is switched to the paper jam handling state or from the full-color mode to the monochrome mode, movable sheet guide 33 rotates about pivot shaft 33*a* with the downward movement of conveyer and transfer belt mechanism 213 of conveyer and transfer belt 216 so that its inclination changes greatly. However, the rotational force acting on movable sheet guide 33 is derived from the abutment point of movable sheet guide 33 upon fixer entrance sheet guide 30.

This abutment point is located at $X_1$ around the distal end of movable sheet guide 33 on the downstream side, away from pivot shaft 33*a* when movable sheet guide 33 rotates upward due to the downward movement of conveyer and transfer belt mechanism 213. Therefore, if conveyer and transfer belt mechanism 213 moves down quickly, movable sheet guide 33 will not jump.

Figure 7A:
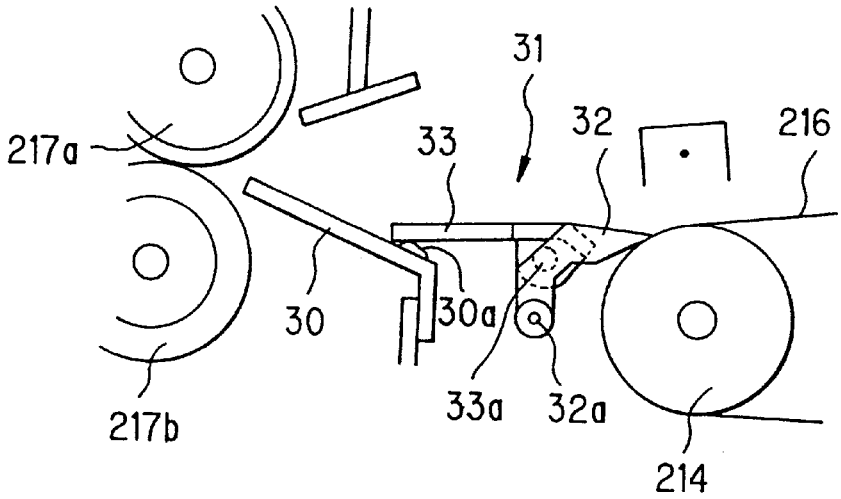
FIGS. 7A to 7C are partially enlarged views of a sheet conveying system in accordance with the second embodiment of a digital color copier of the invention, FIG. 7A showing the state in the full-color mode, FIG. 7B showing the state in the monochrome mode and FIG. 7C showing the state during paper jam handling.
Figure 7B:
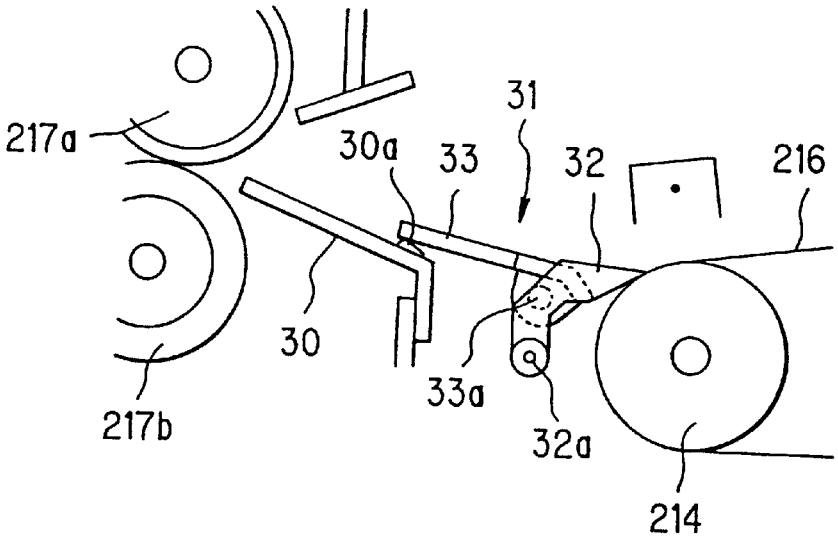
Figure 7C:
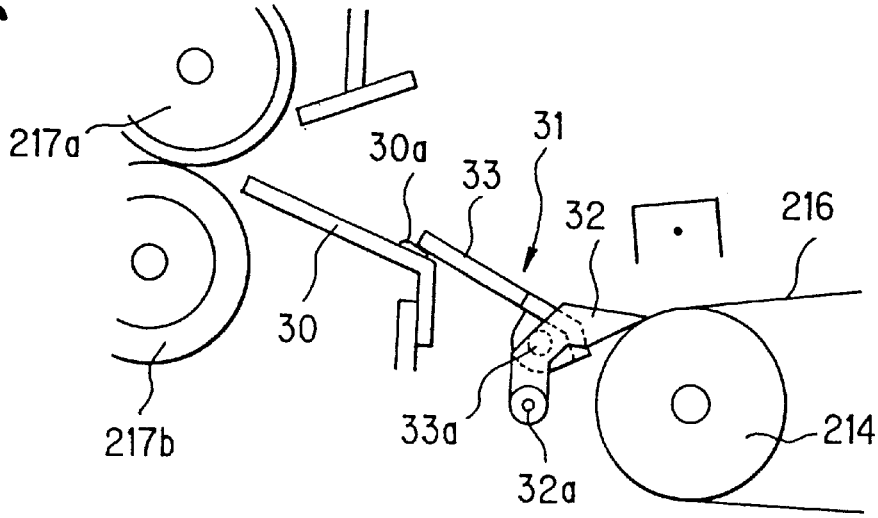

Next, description will be made of a sheet conveyance guide 31 configured as shown in FIG. 7 in accordance with the second embodiment of a sheet conveying system of the invention. FIG. 7A is a sectional view showing the state of a sheet conveyance guide 31 in the full-color mode, FIG. 7B is a sectional view showing the state of sheet conveyance guide 31 in the monochrome mode and FIG. 7C is a sectional view showing the state of sheet conveyance guide 31 during paper jam handling.

As shown in FIG. 7, a projection 30*a* is formed on the upstream side of the sheet guide surface of fixer entrance sheet guide 30 so that this projection 30*a* abuts movable sheet guide 33 and supports the downstream end of movable sheet guide 33.

The position at which this projection 30*a* abuts the underside of movable sheet guide 33 shifts toward the distal end on the downstream side of movable sheet guide 33 as movable sheet guide 33 moves down together with the downward movement of conveyer and transfer belt mechanism 213.

In other words, the distance from pivot shaft 33*a* of movable sheet guide 33 to the abutment point becomes longer as conveyer and transfer belt mechanism 213 moves down, so as to prevent movable sheet guide 33 from jumping upward.

Movable sheet guide 33 in the full-color mode shown in FIG. 7A is set in such a position as to guide paper P separated by separation claws 32, in a direction slightly downward with respect to the horizontal direction and introduce it onto the sheet guide surface of fixer entrance sheet guide 30 with reduced swaying of the front end of paper P.

Movable sheet guide 33 in the monochrome mode shown in FIG. 7B is moved into such a position that the sheet guide surface of movable sheet guide 33 is inclined with respect to the horizontal direction, at a middle angle between the inclination of the sheet guide surface of separation claws 32 with respect to the horizontal direction and the inclination of the sheet guide surface of fixer entrance sheet guide 30 with respect to the horizontal direction, in order to suppress the front end of the separated paper P from swaying. When these three elements are set in such a positional relationship, the abutment point between projection 30*a* on fixer entrance sheet guide 30 and movable sheet guide 33 moves, thus allowing a smooth rotation (change in state) of movable sheet guide 33 without giving any impacts on other elements or degrading conveyance of paper P.

Movable sheet guide 33 during the state of paper jam handling shown in FIG. 7C is positioned in such a configuration that the inclination of the sheet guide surface of movable sheet guide 33 with respect to the horizontal direction is greater than the inclination of the sheet guide surface of separation claws 32 with respect to the horizontal direction and than the inclination of the sheet guide surface of fixer entrance sheet guide 30 with respect to the horizontal direction.

However, similarly to the first embodiment described above, since no paper P is conveyed during paper jam handling, this configuration is free from any problem of paper P jamming or degradation of its conveyance.

Since projection 30*a* on fixer entrance sheet guide 30 creates spacing between the sheet guide surface of fixer entrance sheet guide 30 and movable sheet guide 33, movable sheet guide 33 will not come into directly contact with the sheet guide surface of fixer entrance sheet guide 30 by virtue of projection 30*a*. So, if a fixer entrance sheet guide 30 having a sheet guide surface coated with a fluororesin such as Teflon etc. is used in order to improve the conveyance of paper P by fixer entrance sheet guide 30, the membrane of the fluororesin on the sheet guide surface can be prevented from being damaged.

Figure 8:
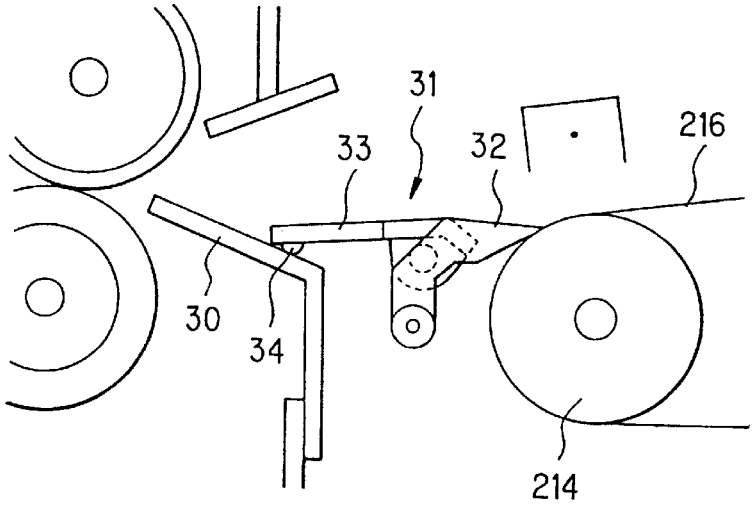
FIG. 8 is a partially enlarged view of a sheet conveying system in accordance with the third embodiment of a digital color copier of the invention.

Though the above projection 30*a* is formed on the sheet guide surface of fixer entrance sheet guide 30, a projection 34 may be formed on the rear surface (undersurface) at the downstream end of movable sheet guide 33 as shown in FIG. 8 (the third embodiment).

Figure 9A:
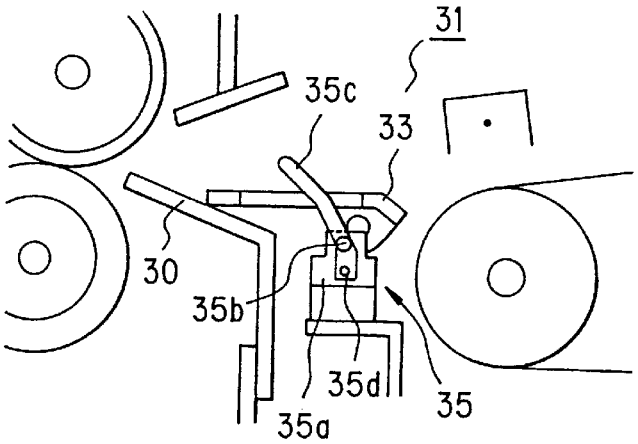
FIGS. 9A and 9B are partially enlarged views of a sheet conveying system in accordance with the fourth embodiment of a digital color copier of the invention, FIG. 9A showing the state in the full-color mode and FIG. 9B showing the state in the monochrome mode.
Figure 9B:
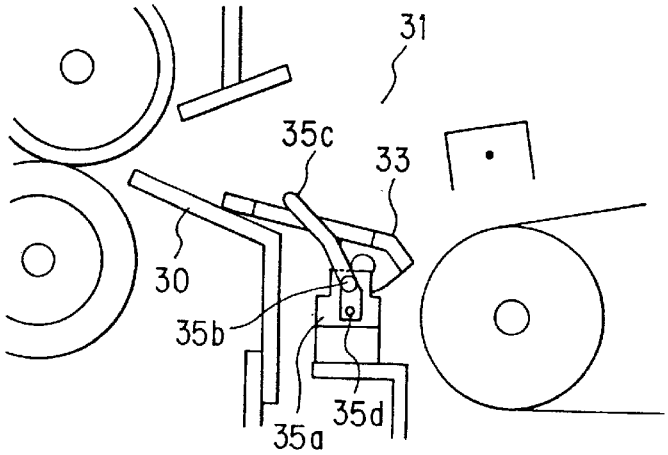

Next, description will be made of a sheet conveyance guide 31 configured as shown in FIG. 9 in accordance with the fourth embodiment of a sheet conveying system of the invention. FIG. 9A is a sectional view showing the state of a sheet conveyance guide 31 in the full-color mode and FIG. 9B is a sectional view showing the state of sheet conveyance guide 31 in the monochrome mode.

As shown in FIG. 9, in this fourth embodiment, a sheet detector 35 is provided for sheet conveyance guide 31. This sheet detector 35 is configured of a detecting portion 35*a* for detecting the conveyance of a sheet of paper P and a detecting arm 35*c* as a sheet detecting piece which can rotate on a shaft 35*b* integrally with detecting portion 35 and is projected upward above the sheet guide surface of movable sheet guide 33. This sheet detecting portion 35 is fixed to first transfer frame 11 (FIGS. 2 to 4) so that it can move up and down integrally with conveyer and transfer belt mechanism 213.

Detecting portion 35*a* has an optical path 35*d* from a light emitting element to a photoreceptor element so as to detect paper P by checking whether detecting arm 35*c* shades optical path 35*d*.

When conveyer and transfer belt mechanism 213 (FIGS. 1 to 4) moves down from the full-color mode shown in FIG. 9A to the monochrome mode shown in FIG. 9B, sheet detector 35 moves down with first transfer frame 11. Movable sheet guide 33 rotates by this downward shift so that the projected amount of detecting arm 35*c* of sheet detector 35 above movable sheet guide 33 becomes smaller than that shown in FIG. 9A. However, the tilt of sheet detector 35 itself is small, so that the shaded state of optical path 35*d* by detecting arm 35*c* is stable.

Figure 10:
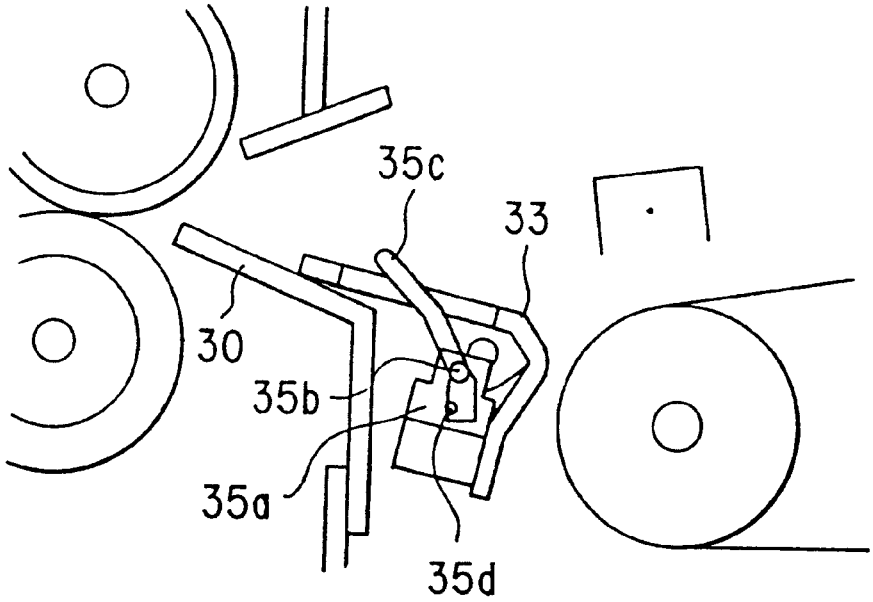
FIG. 10 is a sectional view of a comparative example to be compared to the sheet conveying system of the fourth embodiment of a digital color copier of the invention.

In contrast, in a comparative configuration where sheet detector 35 is fixed to movable sheet guide 33 so that it rotates integrally with movable sheet guide 33 as shown in FIG. 10, if movable sheet guide 33 rotates in the monochrome mode as shown in FIG. 10, the tilt angle of sheet detector 35 becomes large so that only the outer part of detecting arm 35*c* will shade optical path 35*d*. Therefore, when detecting arm 35*c* reverts back to the original position after passage of paper P, detecting arm 35*c* sways closing and opening optical path 35*d* in an alternate manner, causing chattering on the detection output from sheet detector 35, which might be mal-detected as an occurrence of paper jam.

If a coil spring etc. is used to urge detection arm 35*c* in the clockwise direction in the figure in order to avoid the above mal-detection, chattering due to swaying of detection arm 35*c* can be avoided but the impact acting on paper P when it has been conveyed and collides with detection arm 35*c* becomes large, giving rise to a problem of the transferred toner images being misregistered on paper P.

Consequently, as shown in FIG. 9, sheet detector 35 is fixed to first transfer frame 11 so that it can move down together with first transfer frame 11, thus making it possible to reliably detect the conveyance of paper P. Further since sheet detection by sheet detector 35 is reliable, it is possible to prevent degradation in the strength of movable sheet guide 33 even if an opening is cut out from movable sheet guide 33 in order to position detecting arm 35*c* of sheet detector 35.

In the above embodiments, the first guide element is conveyer and transfer belt 216, and the conveyer and transfer belt 216 is configured to move on its downstream side so as to change the relative positional relationship between conveyer and transfer belt 216 and fixer entrance sheet guide 30 as the second guide element. However, in other configurations, conveyer and transfer belt 216 may be assumed to be the second guide element and the sheet guide for conveying paper P to conveyer and transfer belt 216, arranged upstream of conveyer and transfer belt 216 may be assumed to be the first guide element. In this case, conveyer and transfer belt 216 is configured so as to be able to move on the upstream side, while a sheet conveyance guide 31 is arranged between conveyer and transfer belt 216 and the sheet guide. By this arrangement, when the relative positional relationship between conveyer and transfer belt 216 and the sheet guide changes, it is possible to stably convey paper P to conveyer and transfer belt 216 while preventing degradation of paper positioning precision so that the paper will not be conveyed skewed. Further, the present invention can be also applied to other paper conveying unit, not limited to the conveyer and transfer belt.

In the present embodiments, the present invention is applied to the configuration in which either the first guide element or the second guide element, but not both, is provided so as to be movable. However, the present invention can be applied to a configuration in which both the first and second guide elements are provided so as to be movable. That is, in accordance with the invention, in any configuration in which the relative positional relationship between the first and second guide elements is varied, provision of sheet conveyance guide between these two elements realizes a stable conveyance of paper from the first guide element to the second guide element, to thereby correct the degradation of the paper conveyance state which would occur due to the change in the relative positional relationship between the two guide elements.

What is claimed is:

1. A sheet conveying system comprising:

a sheet conveying unit retaining and conveying a sheet;

a first switching unit for switching the state of the sheet conveying unit on the downstream side with respect to the sheet conveying direction, between a first conveyance position and a second conveyance position;

a separating member having an end part, on the upstream side with respect to the sheet conveying direction, abutted on the sheet conveying unit, for separating the sheet retained on the sheet conveying unit and guiding the sheet to the downstream side with respect to the sheet conveying direction;

a second switching unit for switching the separating member between a first separation/guidance position and a second separation/guidance position; and a sheet guide element located downstream of the separating member with respect to the sheet conveying direction, characterized in that when the state of the sheet conveying unit is switched by the first switching unit from the first conveyance position to the second conveyance position, the second switching unit switches the state of the separating member from the first separation/guidance position to the second separation/guidance position to change the abutment position of the end part, on the upstream side with respect to the sheet conveying direction, of the separating member upon the sheet conveying unit.

2. The sheet conveying system according to claim 1, wherein the sheet conveying unit rotates about a first pivot located on the upstream side with respect to the sheet conveying direction when the conveyance position is switched by the first switching unit; and the separating member rotates about a second pivot located on the side opposite to the direction of the movement of the sheet conveying unit from the first conveyance position to the second conveyance position, with respect to the horizontal line passing through the contact point between the sheet retaining surface of the sheet conveying unit and the sheet guide surface of the separating member.

3. The sheet conveying system according to claim 2, wherein the rotational arc locus of the sheet conveying unit about the first pivot differs from the rotational arc locus of the separating member about the second pivot.

4. The sheet conveying system according to claim 1, wherein the sheet guide element is axially supported on a rotary shaft so that its state is switched from the first guidance position to the second guidance position as the separating member is switched by the second switching unit from the first separation/guidance position to the second separation/guidance position.

5. A sheet conveying system comprising:

a first guide element for guiding a sheet conveyed by a sheet conveying unit;

a second guide element disposed downstream of the first guide element with respect to the sheet conveying direction;

a third guide element disposed between the first guide element and the second guide element for introducing the sheet guided by the first guide element to a second guide element; and a shifting unit for shifting the position of the first or second guide element in order to change the relative positional relationship between the first and second guide elements, wherein the third guide element is transformed and/or made to move its position in conformity with the position of the first or second guide element shifted by the shifting unit.

6. The sheet conveying system according to claim 5, wherein the first guide element is configured of the sheet conveying unit that conveys a sheet by attracting it thereto;

and the third guide element is configured of an upstream side sheet guide having its upstream end part which is abutted against the first guide element and moves integrally therewith when the first guide element is moved by the shifting unit and a downstream side sheet guide which is transformed and/or made to move its position in conformity with the movement of the first guide element.

7. The sheet conveying system according to claim 6, wherein a projection is formed on the upstream end part of the second guide element or on the downstream end part of the third guide element in such a manner that the projection abuts the downstream side sheet guide of the third guide element or the sheet guide surface of the second guide element in order to create spacing between the downstream side sheet guide and the sheet guide surface of the second guide element, preventing the former from coming into contact with the latter.

8. The sheet conveying system according to claim 5, wherein the third guide element comprises a sheet detecting unit having a sheet detecting piece projected from the guide surface of the third guide element; and the sheet detecting unit is arranged so as to integrally move with the first or second guide element as they are moved by the shifting unit.

9. The sheet conveying system according to claim 5, wherein the third guide element is configured of an upstream side sheet guide having an upstream end part abutted on the first guide element and a downstream side sheet guide pivotally supported by a shaft on the upstream end side thereof; and a downstream end part of the downstream side sheet guide abuts the second guide element so that the abutment point serves as the point of action for rotating the downstream side sheet guide when the first or second guide element is moved by the shifting unit.

10. The sheet conveying system according to claim 5, wherein the third guide element is made to move its position and/or transformed in such a way that the deflection of the sheet guiding direction from the first guide element to the second guide element when the sheets are to be conveyed and guided is equal to or smaller than the deflection of the second guide element, and the third guide element is made to move its position and/or transformed in such a way that the deflection when no sheets are to be conveyed and guided is larger than the deflection of the second guide element.

* * * * *